United States Patent [19]

Haller et al.

[11] Patent Number: 4,487,166

[45] Date of Patent: Dec. 11, 1984

[54] START-UP SYSTEM FOR ONCE-THROUGH BOILERS

[75] Inventors: Kurt H. Haller, Akron; Carl Lieb, Norton; Pete G. Todoroff, Akron, all of Ohio

[73] Assignee: The Babcock & Wilcox Company, New Orleans, La.

[21] Appl. No.: 531,093

[22] Filed: Sep. 12, 1983

Related U.S. Application Data

[63] Continuation of Ser. No. 271,142, Jun. 8, 1981, abandoned.

[51] Int. Cl.[3] ..... F22D 7/00

[52] U.S. Cl. ..... 122/406 ST; 60/646; 122/406 S; 122/448 S; 122/479 S

[58] Field of Search ..... 122/406 S, 406 ST, 448 S, 122/479 S, 235 R, 235 C; 60/646, 657

[56] References Cited

U.S. PATENT DOCUMENTS

| | | | |
|---|---|---|---|
| 3,255,735 | 6/1966 | Pacault et al. | 122/406 S |
| 3,304,716 | 2/1967 | Griffin et al. | 60/646 |
| 3,362,164 | 1/1968 | Rudd | 122/406 ST |
| 3,789,805 | 2/1974 | Williams | 122/235 R |
| 3,882,680 | 5/1975 | Durrant et al. | 60/646 |
| 4,262,636 | 4/1981 | Augsburger | 122/406 ST |
| 4,344,338 | 8/1982 | Stevens | 122/235 R |

*Primary Examiner*—Edward G. Favors
*Assistant Examiner*—Steven E. Warner
*Attorney, Agent, or Firm*—Robert C. Mai; J. Henry Muetterties; Robert J. Edwards

[57] ABSTRACT

A start-up system for once-through boilers including the reduction of minimum flow during start-up to 15% full load by the use of multi-lead internal ribbed tubing to the enclosure tubes in the high heat input zones, the use of a variable pressure by-pass stop valve in the main flow path, a pressure reducing means in the by-pass system and two steam spray attemperators from the flash tank or separators. The first steam attemperation is to the outlet of the secondary superheater and the second to the outlet of the reheater.

1 Claim, 4 Drawing Figures

10
12
14
16
18
20
22
24
26
28
30
31
32
34
36
38
40
41
42
44
46
48
50
52
54
56
57
58
59
60
62
64
66
68
70
ECON.
FURN.
PRI. S.H.
SEC. S.H.
FLASH TANK
H.P. HEATERS
FEED PUMP
DEAERATOR
L.P. H'T'R'S
POLISHING SYSTEM
COND.
R.H.
STEAM LINE
DRAIN

START-UP SYSTEM FOR ONCE-THROUGH BOILERS

This application is a continuation of application Ser. No. 06/271,142 filed June 8, 1981, now abandoned.

BACKGROUND OF THE INVENTION

1. Field of the Invention

The present invention relates to a once-through vapor generator, and in particular to a novel start-up bypass system for a once-through vapor generator.

A typical once-through vapor generator, of the type to which the present invention pertains, will include an inlet end and an outlet end, with a plurality of heat transfer surfaces between the ends. As a general rule, these will include an economizer pass, furnace passes defining the high temperature radiant heat transfer portion of the generator, a reheater, and primary and finishing superheating passes, the outlet end of the generator being connected to a suitable point of use such as a high pressure steam turbine. The exhaust flow from the turbine or turbines is transmitted to condensing means, a deaerator, and from there through heat recovery surfaces to the inlet end of the generator.

During start-up of the vapor generator, the low enthalpy fluid cannot be handled by the high pressure turbine, and for this reason, the generator usually is provided with a bypass system to recirculate the flow until the flow is at the enthalpy level required by the turbine. It is known to transmit this flow to heat recovery surfaces where it is passed in heat exchange with the feed flow to the vapor generator inlet end. It is also known to position a flash tank or separator in the bypass system designed to separate the flow entering the bypass system into vapor and liquid streams and to transmit the vapor stream back to the main flow path for warming and rolling the high pressure turbine. Other uses are known for the bypass flow, including turbine gland sealing, and pegging the deaerator.

Depending upon the design of the vapor generator, there may be no flow during at least the initial stages of start-up through certain surfaces, for instance the reheater surfaces of the generator, and perhaps even through primary and finishing superheating surfaces. These surfaces usually are positioned in lower temperature or convection heating zones, so that during the initial stages of start-up, cooling of the surfaces is not necessary. Accordingly, the bypass system usually is connected to the main flow path upstream of at least the finishing superheater surface. This has the advantage that the vapor flow returned to the main flow path from the bypass system flash tank or separator can be subjected to further heating and superheating for earlier warming and rolling of the high pressure turbine, reducing the start-up period.

In a once-through boiler, prior to firing, sufficient flow is required through the boiler pressure parts which are exposed to high gas temperatures during start-up. With smooth furnace tubes, a minimum flow at 25 percent of full load flow generally represents a good balance between furnace tube cooling requirements over the load range and furnace enclosure pressure drop. In the low load range, tube fluid mass flow cannot be reduced appreciably without the possibility of "pseudo film boiling," a condition much like that known as "departure from nucleate boiling" (DNB) at subcritical pressures. Like DNB, pseudo film boiling represents a sudden deterioration of heat transfer at the internal tube surface, which results in unacceptably high levels of tube metal temperatures and must be avoided under all operating conditions.

The multi-lead ribbed tube has found broad acceptance as a tool to prevent DNB in 2400 psi boilers and has proved very effective in preventing pseudo film boiling at supercritical pressures. Ribbed tubing use enables reduction of the minimum flow to 15 percent of full load flow of 3500 psi boilers. Lowering the minimum flow means reduced start-up time, reduced heat loss to the condenser, and reduced auxiliary steam and auxiliary power requirements during start-up. The lower minimum flow also offers the ability to operate the boiler over a wider load range, 20 to 100%, without going on the bypass system. This wider load range can be handled for most domestic coals without oil support and with reasonable net plant heat rates.

On many units, the high pressure turbine has been subjected to temperature dips during start-ups when the steam temperature dropped while ramping throttle pressure. The temperature control problems during start-up stem from the practice of ramping superheater pressure to full operating pressure at relatively low loads. While ramping pressure, superheater flow is raised from approximately 7 to 25%, and simultaneously, flow is shifted from the flash tank to the normal path through the boiler. All of this happens at very low loads where long time lags and large changes in fluid storage and heat storage in the boiler preclude effective steam temperature control.

Developments have taken place to overcome these shortcomings; specifically, to reduce minimum start-up flow, simplify and speed up start-up, permit controlled shutdowns, provide positive control of steam conditions, and enable quick load changes over a wide load range. Some of these developments are; the use of internally ribbed tubes, the concept of dual pressure operation (i.e., capability to operate at variable throttle pressure while maintaining fluid pressure in the economizer, boiler enclosure, and primary superheater), capability of variable throttle pressure operation over a wide load range, and use of saturated steam for attemperation of main and reheat steam during start-up and at low loads.

One problem experienced with conventional bypass systems is that as the vapor generators become larger in size, and of much larger capacity, the bypass systems of necessity must be designed to handle ever greater quantities of flow; that is, the 30% minimum flow becomes increasingly greater in terms of total mass flow. The flash tanks or separators positioned in the bypass systems also must be capable of handling the increased flows as capacities of the generators increase, and since these flash tanks or separators are heavy walled vessels designed to withstand high pressures, and temperatures, it is apparent that the separators or flash tanks become major items in the capital costs of the generator, particularly in the cost of the bypass system. It is known, to use a plurality of smaller sized flash tanks or separator vessels in place of one large very heavy walled vessel. However, whether one or several vessels are used, the expense of this part of the system is high and can be out of proportion when compared with the remainder of the system.

A further disadvantage experienced with conventional bypass systems concerns switch-over of flow from the bypass system to the main flow path at the point in the start-up period when the bypass system is isolated from the flow. Although the bypass systems and flash tanks or separators can be designed to handle flows up to full operating pressures and temperatures in a once-through vapor generator, which may be in the order of 3,600 psi and about 1,100° F., respectively, economics (as discussed above) dictate that the bypass system be designed for and utilized up to only about 1,000 psi, at which time or point in the start-up period the flow is switched over to the main flow path. Since the bypass system is positioned upstream of one or more of the superheating sections, for shorter start-up time, there usually is insufficient surface upstream of the bypass system to produce a fully vaporized flow at the normal switch-over pressure of about 1,000 psi, at this point in the start-up period. The result is that the surfaces downstream of the bypasss system, which prior to switch-over, will have received a vapor flow from the flash tank or separator, will now receive a vapor-liquid mixture flow from the upstream surfaces, resulting in a temperature drop in the surfaces downstream of the bypass system and an undesirable temperature shock to these surfaces.

2. Description of Prior Art

U.S. Pat. No. 3,529,580 (Stevens) describes a once-through vapor generator comprising a main flow path and a bypass system which includes a first and second conduit means connected to the main flow path, a flash tank means, vapor and liquid return lines from the flow tank, and the second conduit means leading to the heat recovery surfaces and including a valve means therein so as to apportion the flow from said main flow path between the first and second conduit means.

U.S. Pat. No. 3,954,087 (Stevens et al) discloses an apparatus and method of start-up of a subcritical and supercritical once-through vapor generator. This system comprises a plurality of separators which are capable of handling full load flow and auxiliary flow paths, one to the condenser and the other to the main flow path between the condenser and vapor generator.

Other revelant prior art consists of U.S. Pat. Nos. 3,338,053 and 3,338,055 (Gorzegno, et al). Disclosed is a start-up apparatus and methods for a subcritical and supercritical vapor generator. This system is comprised of a pressure reducing means in the main flow path between the vapor generating surface and superheaters, a flash tank means connected between the two superheater surfaces, and liquid and vapor bypass conduit means from said flash tank means.

In accordance with the present invention, there is provided a once-through vapor generator comprising a main flow path, heating surfaces, heat recovery surfaces and a bypass system. The bypass system includes a flash tank means sized to handle flow up to at least 25% of full load, a variable superheater bypass stop valve located between the superheating surfaces and sized to handle variable superheating pressure from approximately 15% to full load, and two steam spray attemperators from the flash tank; one to the outlet of the second superheater and the second to the outlet of a reheater located between a first high pressure turbine and a second low pressure turbine.

It is an object of the present invention to overcome the above problems, and in particular to provide a simplified bypass system capable of avoiding the temperature shock experienced in conventional systems during switch-over from the bypass system to main path flow.

It is an object of this invention to maintain minimum flow through the boiler furnace parts exposed to high temperature combustion gases during start-up.

It is an object of this invention to provide means of positive control of steam conditions during start-up and shutdown to suit turbine metal requirements.

It is an object of this invention to recover heat during start-up and low load operation. It is an object of this invention to provide for water cleanup during start-up without delays in boiler and turbine warming operations.

It is the final object of this invention to provide means of operating at variable throttle pressure over the load range while maintaining the necessary supercritical pressure in the furnace circuits.

DESCRIPTION OF THE PREFERRED EMBODIMENT

Figure 1:
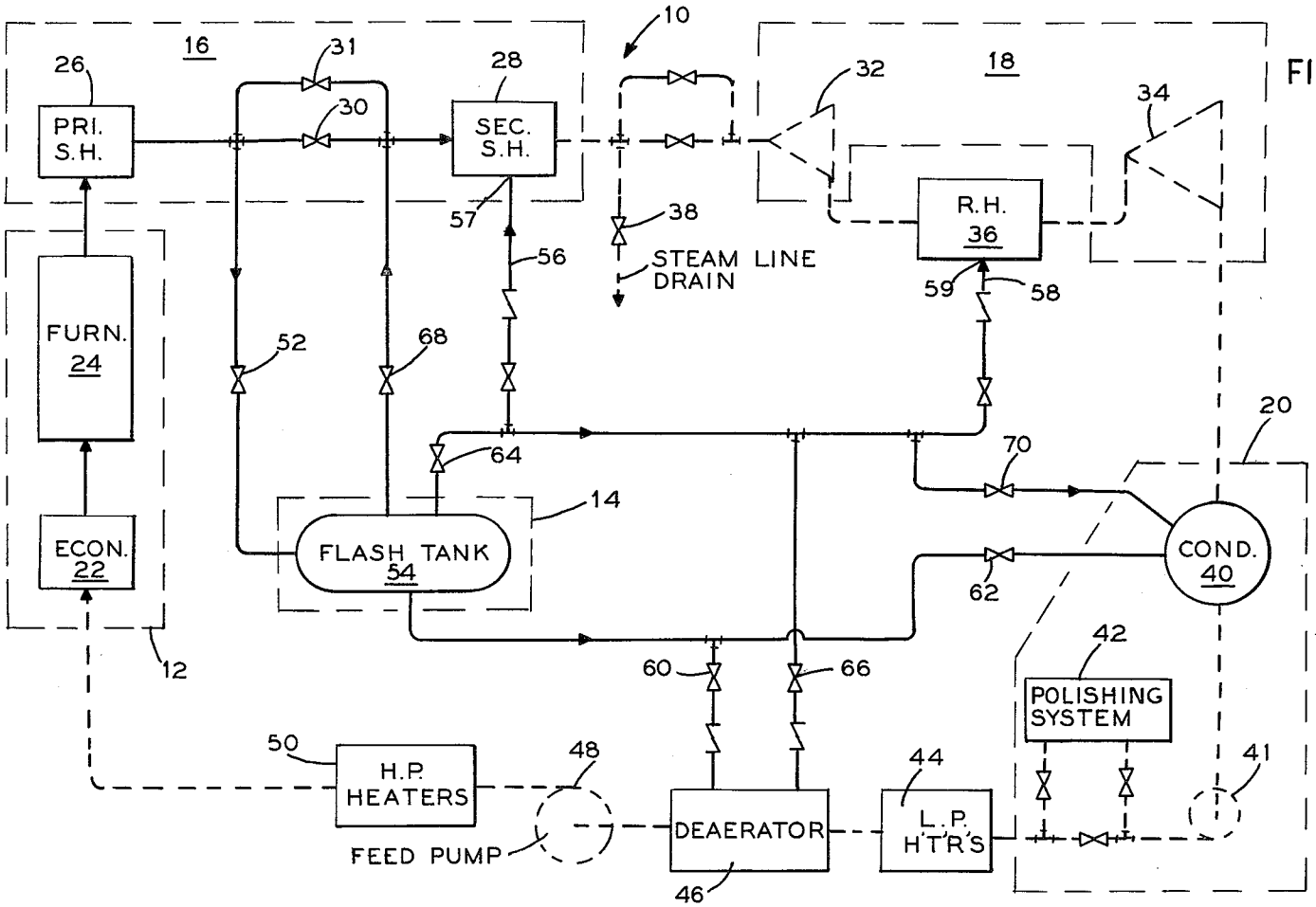
FIG. 1 is a schematic diagram of a once-through boiler start-up system.

Shown in FIG. 1 is a schematic diagram of a once-through boiler start-up system for constant pressure unit 10. Included in the unit 10 is a vapor generating section 12 in parallel flow relationship with a collecting and separating section 14, and in series flow with a superheating section 16, a turbine section 18 and a condensing section 20. It is understood that the connections between these sections, which are shown schematically in the drawings, are achieved by fluid circuitry in the form of tubes, conduits, risers, headers, etc. to transfer heat exchange fluid either in a liquid form or a vapor form throughout the various sections.

The vapor generating section 12 consists of an economizer 22 adapted to receive the heat exchange fluid, which is preferably water, and pass it to a furnace 24, after which it is passed to the superheating section 16.

The superheating section 16 includes a primary superheater 26 and a secondary superheater 28 which are connected in the vapor circuit in series flow relationship in the vestibule section and the convection section of the vapor generating unit. A full capacity stop valve 30 and a stop by-pass pressure reducing valve 31, in parallel flow with each other, are located in the vapor circuit between the primary and secondary superheater, 26 and 28 respectively. Note that although only one stop or steam flow valve 30 and one stop bypass valve 31 are shown there could be a plurality of each valve. The function of valves 30 and 31 could be combined into one inline valve.

The vapor output from the secondary superheater 28 is adapted to be connected to the turbine section 18 which includes a high pressure turbine 32 and a low pressure turbine 34. A reheater 36 which is also located in the convection section, is flow connected between the high pressure turbine 32 and the low pressure turbine 34. The turbines 32 and 34 are driven by the vapor from the secondary superheater 28 and the reheater 36 respectively and are adapted to drive an electric generator or the like (not shown) in a conventional manner. A drain line 38 is connected to the vapor circuit between the secondary superheater 28 and the high pressure turbine 32 to enable the vapor circuit to be warmed prior to rolling of the high pressure turbine 32 as will be explained later.

The outlet from the low pressure turbine 34 is connected to the condenser section 20 which includes a condenser 40, a pump 41 and a condensate polishing system 42. The exhaust vapor from the turbine section 18 is passed to the condenser 40 where it is condensed, then pumped by pumps 41 through the condensate polishing system 42 and then on to a plurality of external low pressure heaters designated by reference numeral 44. A deaerator 46 is connected to the output of the low pressure heaters 44 for receiving the condensate before it is circulated, via feed water pump 48, to high pressure heater 50 to further heat the condensate before it enters the economizer of the vapor generating section 12.

The boiler feed pump 48 supplies the minimum required flow of feedwater during start-up and low load operation as required to the furnace circuitry. The addition of multilead internal ribs of the kind well known in the art to the enclosure tubes in the high heat input zones within the convection pass permits lower velocity limits, so the same size enclosure tubes can be used, and the minimum flow reduced from 25% to 15%. Since the velocities of the liquid in the tubes at full load are the same as before the addition of the ribs, there is only a slight increase in the pressure drop due to the slightly higher friction factor created by the ribbed tubing. During early start-up, all of the flow goes through the primary superheater 26 and bypasses the secondary superheater 28 through the bypass system's pressure reducing valve 52 to the flash tank 54 where the water-steam mixture is separated. The water flows to a deaerator 46 and a condenser 40. The steam flows from flash tank 54 through two attemperator lines 56 and 58. The overall water level in the flash tank 54 is controlled by drain valves 60 and 62. The drain valve 60 controls the flow to the deaerator 46 for maximum heat recovery. Excess water above the capacity of the deaerator 46 is discharged to the condenser 40 through drain valve 62. If the flow through drains 60 and 62 is not within water quality limits, all of the flow is through valve 62 to the condenser 40 and a polishing system 42.

The return block valve 64 from the flash tank 54 remains closed until a level is established in the flash tank 54 to assure that water will not enter the steam attemperator lines 56 and 58. Once a level is established the block valve 64 is opened and then the deaerator steam pegging line 66 from the flash tank 54 can be used to hold pressure in the deaerator 46 (controlled by valve 66). This permits returning all of the excess flow to the condenser 40 through the drain valve 62 during a hot cleanup without using an auxiliary steam source for maintaining deaerator pressure and also serves to recover the heat in the steam during cleanup.

After a predetermined water-steam level is established in the flash tank 54 the bypass return steam valve 68 is opened and the dry steam flows to the secondary superheater 28. Steam separated in the flash tank 54 in excess of that required is relieved through the steam relief valve 70 to the condenser 40. The steam relief valve 70 also acts as an over-pressure relief valve to avoid popping spring loaded safety valves (not shown) on the flash tank 54. Steam relief valve 70 has an adjustable set point which can be set to hold flash tank 54 pressure at desired levels at particular load points during start-up.

The entire bypass system is sized to handle 25% flow during start-up and to permit up to 25% load on the flash tank 54. The transition from operation on the flash tank 54 to straight through flow is made at approximately 25% load. As the steam entering and leaving the flash tank 54 at this time is dry steam, the transition from flow through the pressure reducing valve 52 to flow through the steam flow valve 30 is accomplished without fluctuations in steam temperature. The transition is accomplished by opening the superheater stop valve by-pass valve 31 and the closing of the by-pass valves 52 and 68. As no other transients are occurring at this time, there are no changes in steam temperature and pressure.

Above 25% load the steam flows through the steam flow valve 31 bypassing stop valve 30. The steam flow valve 31 permits variable pressure operation of the superheater section 16 up to full load.

The variable throttle pressure feature is well known in the art and permits operating the unit with the throttle valves almost wide open. This feature eliminates the turbine metal temperature changes resulting from valve throttling and permits rapid load changes without being limited by turbine heating-cooling rates. Shutdown with variable throttle pressure maintains high temperature in the turbine metals and permits rapid restarting.

Figure 2:
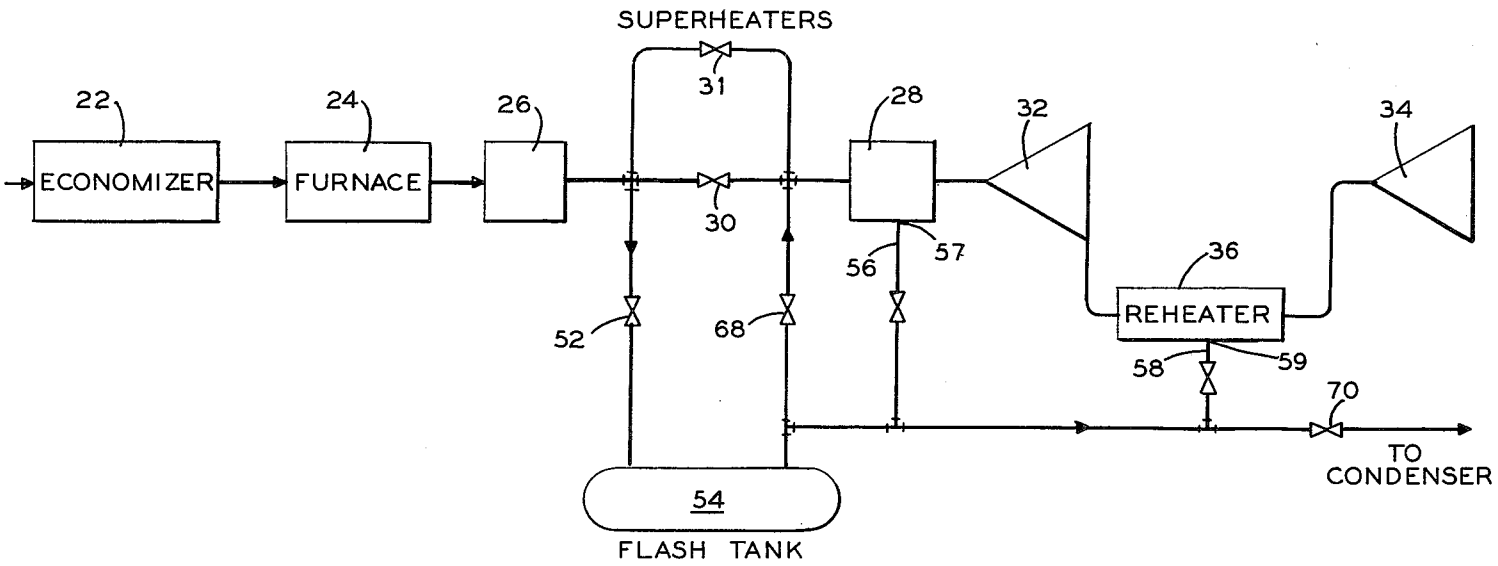
FIG. 2 is a schematic diagram of a once-through boiler start-up system with superheater and reheater steam attemperation.

The start-up system shown in FIG. 2 includes provision for steam attemperation to the secondary superheater and reheat steam outlet headers, points 57 and 59 respectively, for positive control of the steam conditions during start-up to meet the turbine metal requirements. The superheater outlet steam attemperator line 56, is used at low loads to introduce saturated steam from the flash tank 54 to the superheater outlet header 57. Initial rolling of the turbine 32 may be started with saturated steam through steam attemperator line 56, mixed with a limited quantity of steam passing through the return bypass steam valve 68 and the secondary superheater 28 to control the high pressure turbine 32 inlet temperature down to about 550° F.

The steam return control valve 68 is used to acquire the necessary pressure drop between the flash tank 54 and the secondary superheater outlet 57 for attemperation. The reheat outlet steam attemperator line 58 is used at low loads to introduce flash tank steam to the reheat outlet header 59. The ratio of flow through the attemperator line 58 and the high pressure turbine 32 is limited to 1:1, for turbine consideration mainly to limit windage heating in the high pressure turbine 32.

Figure 3:
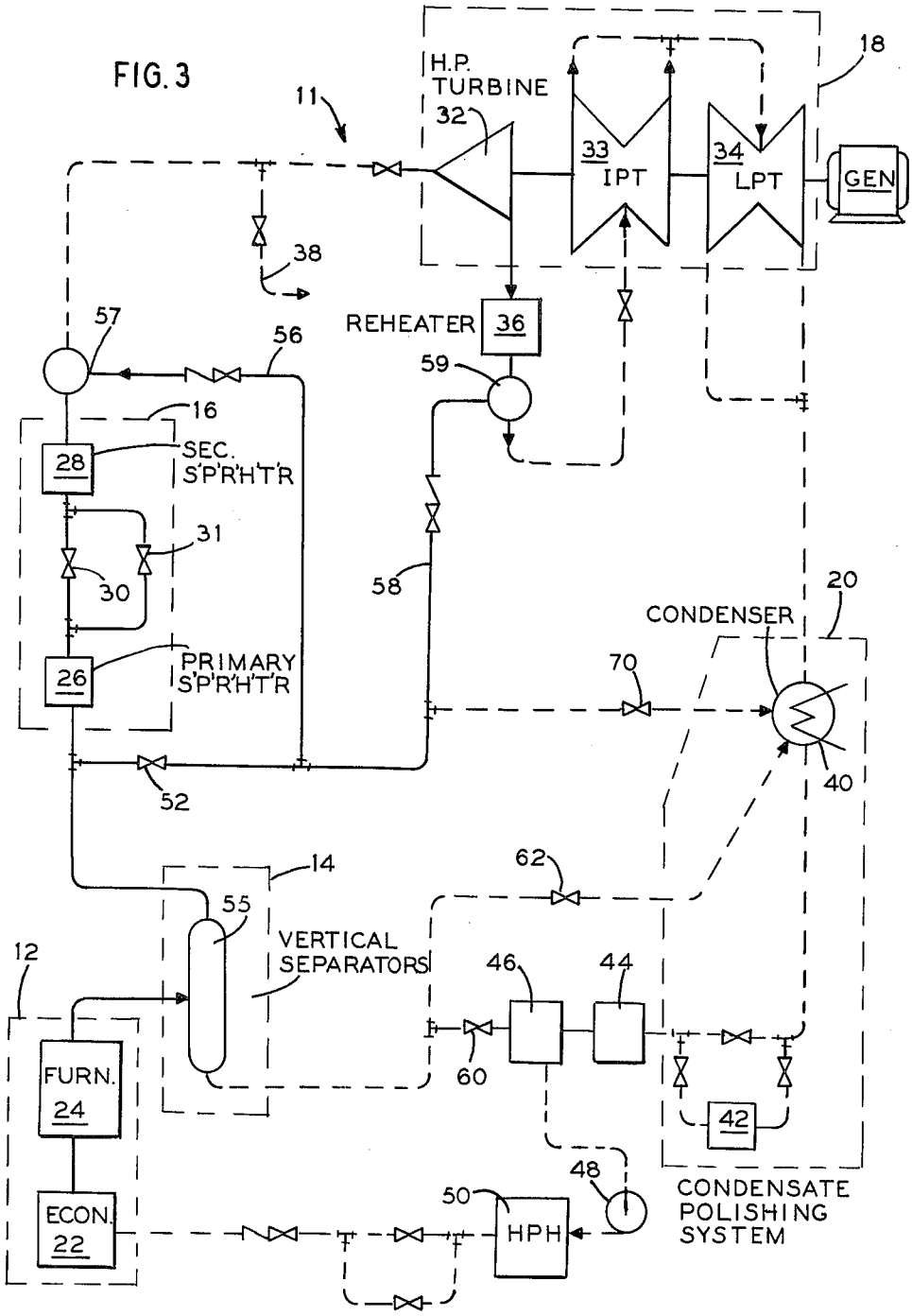
FIG. 3 is a schematic diagram of a once-through boiler start-up system for variable pressure operation.

FIG. 3 is a schematic diagram of a power plant with a variable pressure once-through vapor generator unit 11. Included in the unit 11 is a vapor generating section 12 connected in a series flow relationship with a collecting and separating section 14, a superheating section 16, a turbine section 18, and a condensing section 20.

The collecting and separating section 14 is composed of vertical separators 55 and is connected in series flow with the vapor generation section 12 and the superheating section 16.

The superheating section 16 includes a primary superheater 26 and a secondary superheater 28. A stop valve 30 and a stop bypass valve 31, in parallel flow with each other, are flow connected between the two superheaters.

In the vapor generating unit 11 a pressure reducing valve 52 is connected to the main steam line before the primary superheater 26. Flow through valve 52 is used as the source of steam attemperation, as will be discussed later.

The vapor output from the secondary superheater 28 is adapted to be connected to the turbine section 18 which is shown to include high pressure turbine 32 and low pressure turbine 34. An intermediate pressure turbine 33 can be used if desired and located between the high and low pressure turbines, 32 and 34 respectively. The reheater 36 is flow connected between the high pressure turbine 32 and the intermediate pressure turbine 33. The outlet from the low pressure turbine 34 is flow connected to the condenser section 20. The boiler feedwater pump 48 supplies the minimum required flow of feedwater during start-up and low load operation as required to protect the furnace circuitry. Included in the circuitry for start-up are an economizer 22, a furnace enclosure 24, and a separating vessel 55. The water-steam mixture leaving the furnace is separated in the separating vessel 55 during start-up and low load operation.

Drain valves 60 and 62 control the liquid drainage from the separator 55. Valve 60 controls the flow to the deaerator 46 for maximum heat recovery. Excess water not sent to the deaerator 46 is discharged to the condenser 40 through valve 62, which controls the water level in the separator 55. If the flows through the drains are not within water quality limits, all of the flow is through valve 62 to the condenser 40 and then to polishing system 42.

The dry steam leaving the separator 55 flows through the convection pass to the primary and secondary superheaters, 26 and 28 respectively. During the initial phase of startup, the flow through the main steam line drain 38 is used for warm up of the steam lines.

Generally during hot starts, including starts following overnight shutdowns, the gas temperature leaving the furnace 24 has to be kept high to maintain high main steam and reheat temperature. This results in too rapid a rise in throttle pressure which is undesirable because of the resulting large throttling temperature drop when admitting steam to the turbine 32. By means of the superheater stop valve 30 and bypass means, the saturation pressure surface can be isolated from the secondary superheater. The overfiring required to raise and maintain steam temperatures can be allowed to raise saturation temperature or boiler pressure while maintaining the desirable low pressure entering the high pressure turbine 32 and in the secondary superheater 28.

When reaching the maximum desired boiler pressure or when starting up with the superheater stop valve 30 open, the superheater by-pass system to the condenser 40 (or low pressure auxiliary steam system) provides the means to control or limit boiler pressure during hot start conditions. During the transient loading period for the unit following a hot restart, the superheater by-pass valve 70 may be opened to permit higher firing rates and thus sustain rated steam temperature until the boiler control load is reached. Thus the by-pass and control system has the capability to continuously maintain desired steam temperatures during the transient time of loading the unit 11 from start-up to full load following a hot restart.

Before steam is taken to the turbine 32, the reheater 36 is without flow. The reheater metal absorbs heat from the flue gas and eventually reaches the flue gas temperature which can be as high as 1000° F. (538° C.). When steam is first admitted to the turbine 32 and thereafter passing through the reheater 36, reheat outlet steam temperature rises very rapidly to the gas temperature level, resulting in a poor match with turbine metal temperatures for cold starts.

Reheat steam attemperation with saturated steam from the separator 55 permits reducing reheat outlet steam temperature when steam is first admitted to the turbine 32, and offers positive reheat steam temperature control at low loads. Control of the saturated steam flow to the reheater outlet attemperator is provided by line 58. The ratio of flow through the attemperator line 58 and the high pressure turbine 32 is limited to 1:1 for turbine considerations.

For cold starts and starts following weekend shutdowns, the requirements of low steam temperature for a temperature match with the metal component and high heat input for a quick start-up, are not compatible. With low steam flows, the main steam temperature approaches the gas temperature in the vicinity of the secondary superheater outlet 57. Therefore to keep the steam temperature low, the gas temperature must be kept low, however the heat input must be high enough to generate sufficient steam for rolling and initial loading of the turbine section 18.

The superheater outlet steam attemperator 56 utilizing steam from the separator 55, overcomes this problem by permitting steam temperature control independent of heat input to the vapor generating section 12. In order to by-pass saturated steam from the vapor generating section 12 to the secondary superheater outlet 57, it is necessary to use stop valve 30 and stop by-pass valve 31 between the primary and secondary superheater, 26 and 28 respectively, to provide flow resistance and to control flow through the secondary superheater 28.

The superheater outlet steam attemperator line 56 is used at low loads to introduce saturated steam from the separator 55 to the superheater outlet 57 for rolling the turbine 32. Initial rolling of the turbine 32 may be started with saturated steam through the superheater outlet steam attemperator line 56, mixed with a limited quantity of steam passing through the stop by-pass valve 31 and through the secondary superheater 28 to control the high pressure turbine 32 inlet temperature to the desired value.

Figure 4:
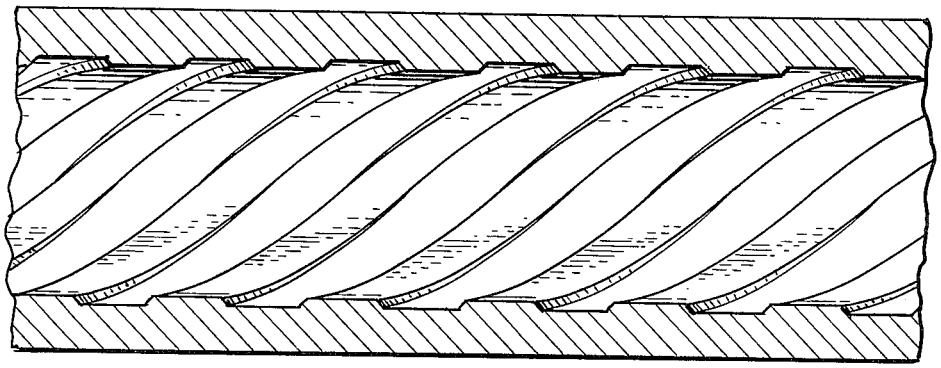
FIG. 4 is a longitudinal section of a multi-lead ribbed tube.

FIG. 4 is a sectional view of a multi-lead ribbed tube used in the furnace enclosure of the invention.

While in accordance with the provisions of the statutes there is illustrated and described herein a specific embodiment of the invention and those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. In combination with a power plant system having a main once-through fluid flow path connected in series with furnace enclosure tubular means, primary and secondary superheaters, high and low pressure turbine means with a reheater connected therebetween, the improvement comprising utilization of multi-lead ribbed tubing as the tubular means whereby minimum start-up flow is reduced to approximately 15 percent of full load flow, a start-up system including a flash tank, valve means interposed between the primary and secondary superheater and in parallel with the main flow path whereby the transition from operation through the start-up system to flow through the main flow path is accomplished without fluctuation in steam temperature and wherein the valve means provide supercritical pressure upstream of the primary superheater outlet and variable pressure downstream of the secondary superheater inlet over the greater portion of the load range.

* * * * *